US008151609B2

(12) United States Patent
Stobbe et al.

(10) Patent No.: US 8,151,609 B2
(45) Date of Patent: Apr. 10, 2012

(54) LOCK CYLINDER ARRANGEMENT

(75) Inventors: Anatoli Stobbe, Barsinghausen (DE); Wilfried Herrmann, Hannover (DE)

(73) Assignee: ASTRA Gesellschaft für Asset Management mbH & Co. KG, Barsinghausen (DE)

( * ) Notice: Subject to any disclaimer, the term of this patent is extended or adjusted under 35 U.S.C. 154(b) by 451 days.

(21) Appl. No.: 12/386,162

(22) Filed: Apr. 14, 2009

(65) Prior Publication Data

US 2009/0255303 A1 Oct. 15, 2009

(30) Foreign Application Priority Data

Apr. 14, 2008 (DE) ..... 10 2008 018 906

(51) Int. Cl.
*E05B 49/00* (2006.01)

(52) U.S. Cl. ..... 70/278.7; 70/276; 70/278.1; 70/278.3

(58) Field of Classification Search ..... 70/276, 70/278.1, 278.2, 278.6, 278.7, 283.1
See application file for complete search history.

(56) References Cited

U.S. PATENT DOCUMENTS

| | | | | | |
|---|---|---|---|---|---|
| 3,919,869 | A * | 11/1975 | Fromm | 70/263 |
| 4,583,148 | A * | 4/1986 | Lipschutz | 361/172 |
| 4,703,636 | A * | 11/1987 | Minami | 70/229 |
| 4,848,115 | A * | 7/1989 | Clarkson et al. | 70/276 |
| 4,916,927 | A * | 4/1990 | O'Connell et al. | 70/276 |
| 5,469,727 | A * | 11/1995 | Spahn et al. | 70/278.3 |
| 5,862,692 | A * | 1/1999 | Legault et al. | 70/278.1 |
| 5,878,610 | A * | 3/1999 | Friedrich | 70/264 |
| 5,946,956 | A * | 9/1999 | Hotzl | 70/276 |
| 6,227,020 | B1 * | 5/2001 | Lerchner | 70/278.3 |
| 6,293,131 | B1 * | 9/2001 | Lemettinen et al. | 70/278.7 |
| 6,318,137 | B1 * | 11/2001 | Chaum | 70/278.3 |
| 6,370,928 | B1 * | 4/2002 | Chies et al. | 70/278.3 |
| 6,499,325 | B1 * | 12/2002 | Hurskainen | 70/276 |
| 6,588,243 | B1 * | 7/2003 | Hyatt et al. | 70/278.2 |
| 7,000,441 | B2 * | 2/2006 | Sutton et al. | 70/276 |
| 7,069,755 | B2 * | 7/2006 | Lies et al. | 70/278.2 |
| 7,591,160 | B2 * | 9/2009 | Keller | 70/277 |
| 7,721,576 | B2 * | 5/2010 | Amir | 70/472 |
| 7,874,190 | B2 * | 1/2011 | Krisch et al. | 70/277 |
| 7,987,687 | B2 * | 8/2011 | Spycher et al. | 70/278.7 |
| 8,011,217 | B2 * | 9/2011 | Marschalek et al. | 70/473 |
| 2003/0217574 | A1 * | 11/2003 | Meis | 70/257 |
| 2004/0055346 | A1 * | 3/2004 | Gillert | 70/276 |
| 2008/0072636 | A1 * | 3/2008 | Padilla et al. | 70/278.7 |
| 2010/0139343 | A1 * | 6/2010 | Pukari et al. | 70/283.1 |

FOREIGN PATENT DOCUMENTS

| | | |
|---|---|---|
| DE | 545 181 | 2/1932 |
| DE | 90 04 623 | 8/1990 |
| DE | 39 18 445 | 12/1990 |
| DE | 296 03 652 | 8/1997 |
| DE | 197 10 834 | 11/1997 |
| DE | 198 56 292 | 7/1999 |
| DE | 100 32 998 | 12/2001 |
| DE | 103 03 220 | 9/2004 |
| DE | 10 2004 041 518 | 9/2005 |
| EP | 0 453 878 | 10/1991 |
| EP | 0 819 810 | 1/1998 |
| GB | 2 278 631 | 12/1994 |

* cited by examiner

*Primary Examiner* — Suzanne Barrett
(74) *Attorney, Agent, or Firm* — Collard & Roe, P.C.

(57) ABSTRACT

A lock cylinder consisting of a housing with a lock bit, an unlocking device and an actuation device is described.
The unlocking device comprises a coupling arranged between the actuation device and the lock bit, which coupling is decoupled in the locked state and coupled in the unlocked state. The coupling can be electromagnetically or piezoelectrically actuated and the unlocking device is externally fed with energy contactlessly.

14 Claims, 6 Drawing Sheets

LOCK CYLINDER ARRANGEMENT

CROSS REFERENCE TO RELATED APPLICATIONS

Figure 1:
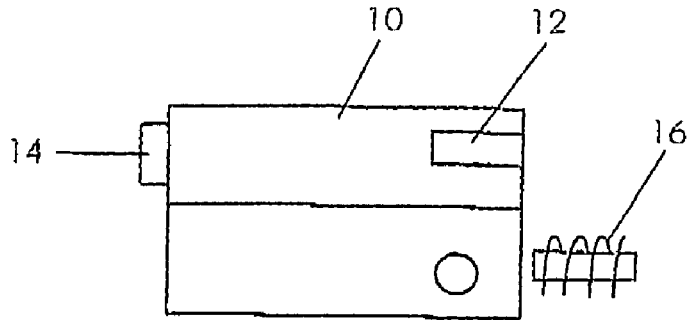

Applicants claim priority under 35 U.S.C. §119 of German Application No. 10 2008 018 906.5 filed on Apr. 14, 2008.

The invention relates to a lock cylinder arrangement according to the preamble of Claim 1.

In the case of a lock cylinder known from DE 39 18 445 C1, an unlocking device consists of a displaceable bar, which in the locked state is blocked by a descended armature of an electromagnet, which is constructed as a latch, and in the unlocked state can be axially displaced by an inserted key when the armature is attracted. Thereafter, a lock bit can be actuated by the key. The energy supply of the electromagnet takes place by means of key contacts of a battery arranged in the key grip.

The object of the invention is to create a lock cylinder arrangement which is better protected against the action of force.

This object is achieved in the case of a lock cylinder arrangement according to the preamble of Claim 1 by means of the features of this claim.

Developments and advantageous configurations result from the subclaims.

In the case of the solution according to the invention, the actuation device is ineffective in the decoupled state of the coupling. During the actuation, free travel or free rotation is executed without having to overcome a blocking. Only after coupling the coupling is the lock bit positively or non-positively connected to the actuation device. The energy necessary for actuating the coupling is fed in contactlessly so that it is neither possible to damage any contacts nor to apply a damaging overvoltage.

An induction loop which is fed with energy by means of an external induction loop and energy source and is arranged in the lock cylinder is preferably connected upstream of the control circuit.

As a result, the energy necessary for actuating the actuator can be transmitted over a short distance through a window in the housing of the lock cylinder.

The external induction loop and energy source can be arranged in a protected region.

In this case, the lock cylinder can simply be configured in such a manner that the actuator is activated as soon as when the external induction loop is supplied with energy.

Alternatively, the external induction loop and energy source can be arranged in a key or operating device which is entrained by a user.

A user in this case requires a compatible key or a compatible operating device in order to supply the actuator with energy by means of the induction loop. As a result, this solution is autarchic and not dependent on a mains connection, however.

The control circuit preferably comprises an electrical energy store which can be charged by means of the induction loop, whereby, by means of the control circuit, the actuator is acted on with an increased switch-on current applied by the energy store in the switch-on phase and is acted on with a lower holding current applied by the induction loop in the holding phase.

The advantage of this solution consists in the fact that the energy balance of the lock cylinder does not have to be designed in accordance with the initial energy requirement of the actuator, but rather can be dimensioned smaller.

In addition, the unlocking device can comprise an electrical emergency opening device which is connected upstream of the control circuit and consists of an additional induction loop facing the unprotected region or of galvanic contacts.

This electrical emergency opening device makes it possible to open the cylinder lock in a non-destructive manner even in the event of the failure of the intended opening opportunity.

The unlocking device can comprise a mechanical emergency opening device which consists of an access channel to the coupling and a predefined break opening in the lock cylinder.

In this configuration, the cylinder lock can also then be opened with moderate effort if all electrical components fail.

According to a development, the actuation device is a fixedly incorporated spring-loaded push, rotary or pull knob.

By integrating the push, rotary or pull knob into the lock cylinder, simple, fast and ergonomic operation is enabled.

Alternatively, the actuation device is a positive-fitting accommodation for a battery-operated key that is inserted from the outside and has a compatible plug-in attachment or plug-on attachment.

As a result, additional security functions can be implemented. Additionally, the lock cylinder can be incorporated sunk or flush with the surface without any protruding parts.

Furthermore, the control circuit can be controlled by a code evaluation circuit which is external or is internal and arranged in the lock cylinder.

The clearance of the lock cylinder for actuation can therefore take place according to diverse security criteria.

The energy supply of the external induction loop in the protected region can be switched on and off via a control line by means of a central code evaluation circuit.

In this solution, no code evaluation circuit is required to be implemented in the lock cylinder itself, as a result of which a more cost effective design is possible.

Alternatively to a mechanical switch contact, the external induction loop can be a constituent of a lock-cylinder presence sensor, by means of which the coupling to the induction loop arranged in the lock cylinder can be monitored via an evaluation circuit.

A presence monitoring of the lock cylinder is possible in this manner without additional presence contact.

An emergency opening can take place by means of a second induction loop by approaching the lock cylinder from the unprotected region in the event of failure of the regular opening function.

Alternatively to central external code evaluation, the control circuit can be activated directly by means of an internal code evaluation circuit in the lock cylinder in the event of code match via a control output of the code evaluation circuit and therefore the lock cylinder can be enabled.

This configuration enables autarchic operation of the lock cylinder even during code evaluation.

The induction loop arranged in the lock cylinder can be constructed as a combined energy and code receiver, which receives energy and code from a key inserted into the key accommodation.

The double use of the induction loop allows the available space and the electronic components to be used optimally in the confined structural conditions in the lock cylinder.

In a practical configuration, the coupling of the unlocking device comprises a spring-loaded rocker arm which is coupled with the actuation device and can be pivoted between a position of engagement and a position of non-engagement with the lock bit. A support surface of the rocker arm is supported on a spring-loaded rocker which can be pivoted between a coupled position and a decoupled position of the rocker arm. The rocker is fixed in the relaxed position by an actuator in the latter's active state and can be pivoted by force action of the rocker arm in the actuator's passive state.

The invention is explained further below with reference to an exemplary embodiment which is illustrated in the drawing.

Figure 2:
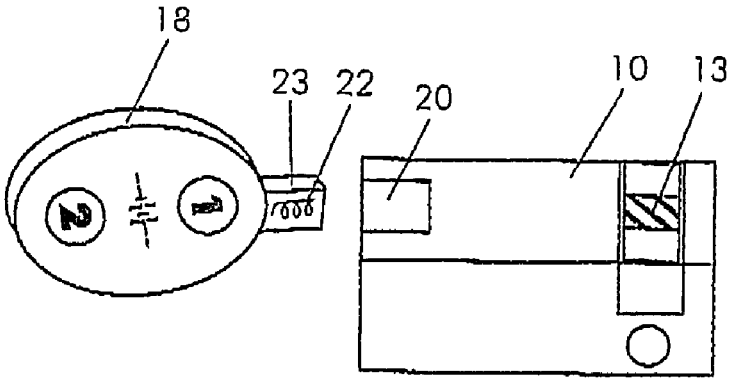
Figure 3:
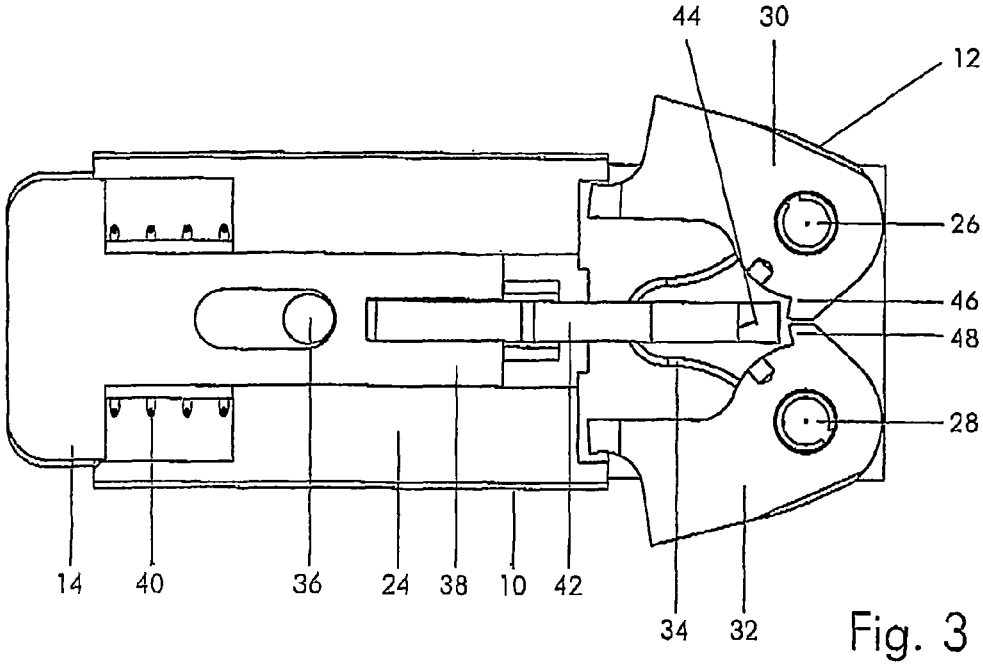
Figure 4:
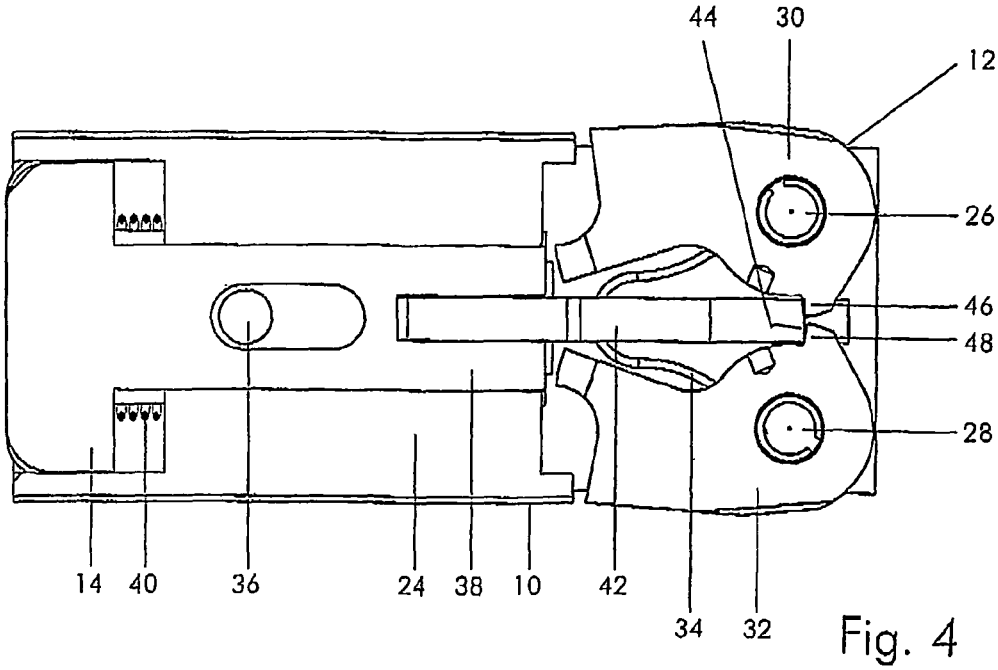
Figure 5:
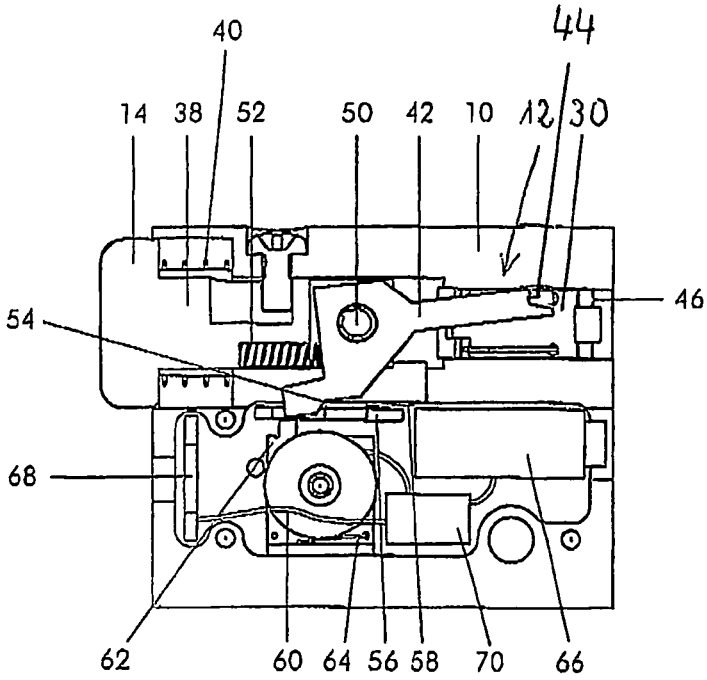
Figure 5:
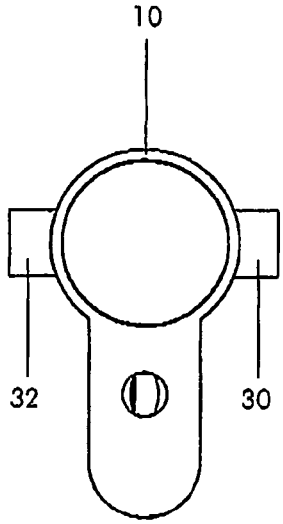
Figure 6:
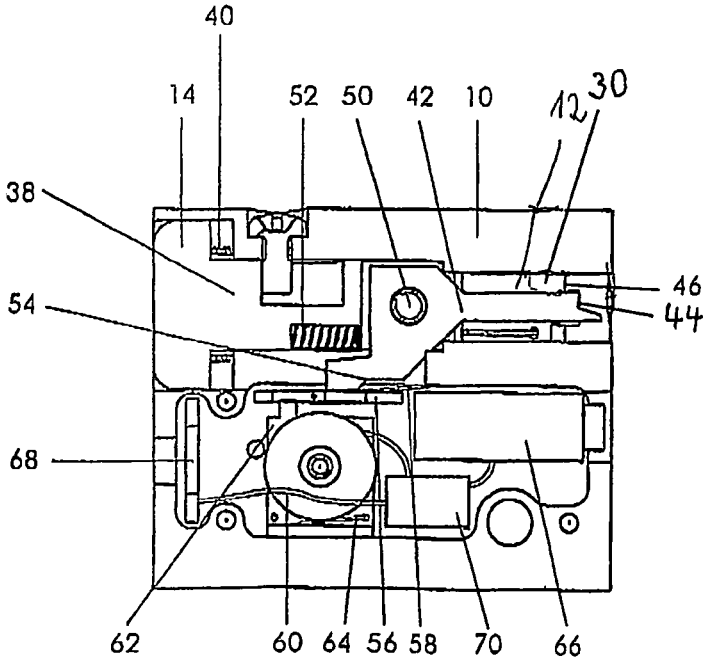
Figure 6:
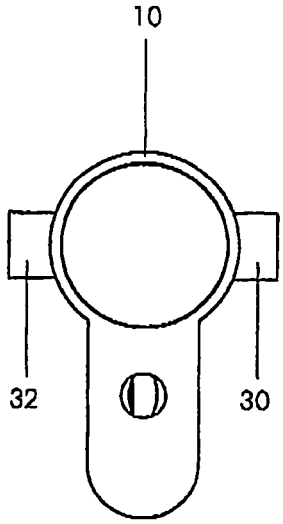
Figure 7:
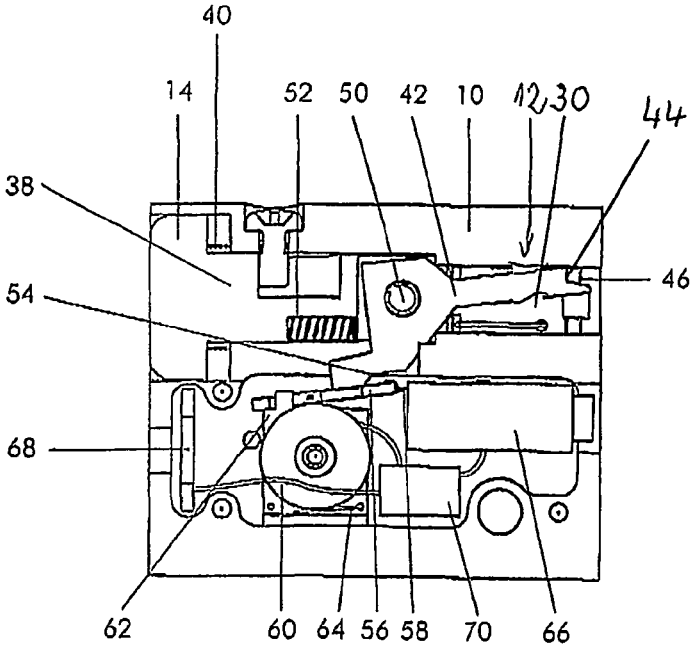
Figure 7:
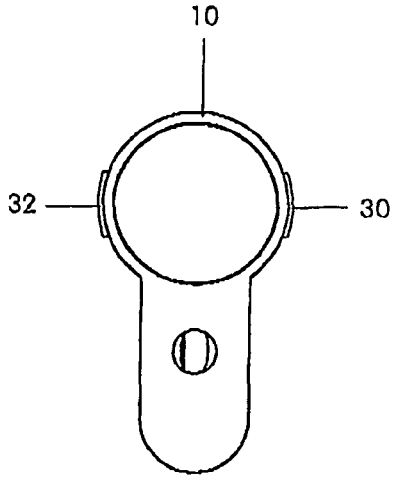
Figure 8:
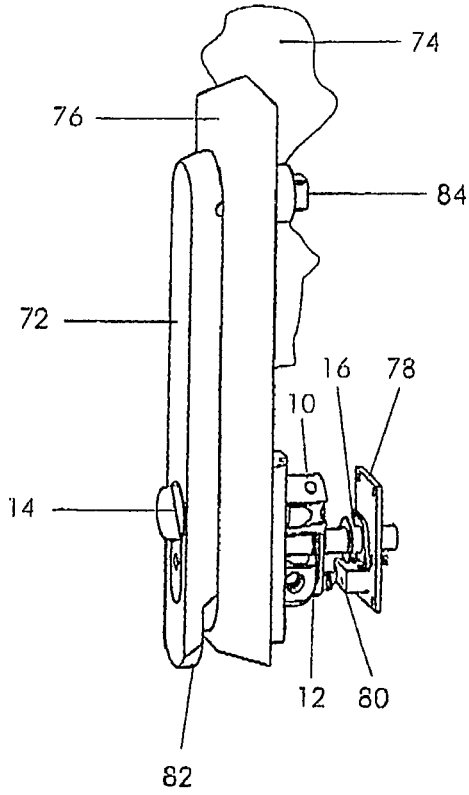
Figure 9:
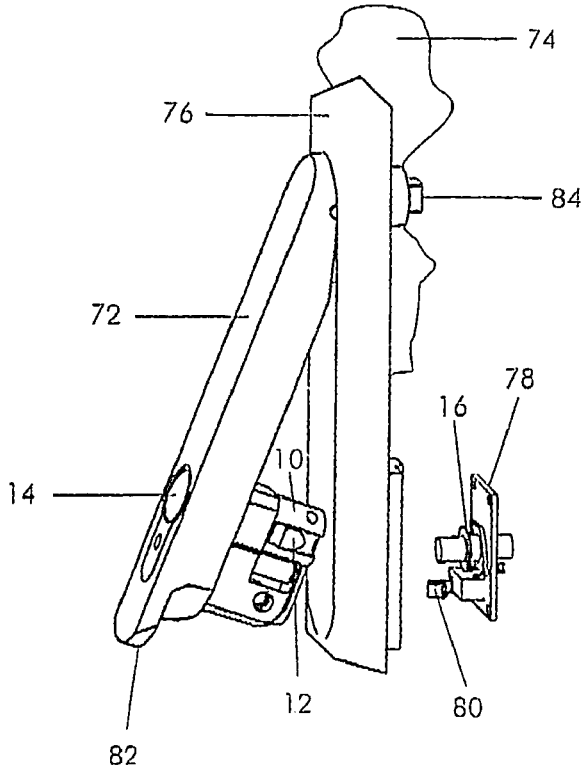
Figure 10:
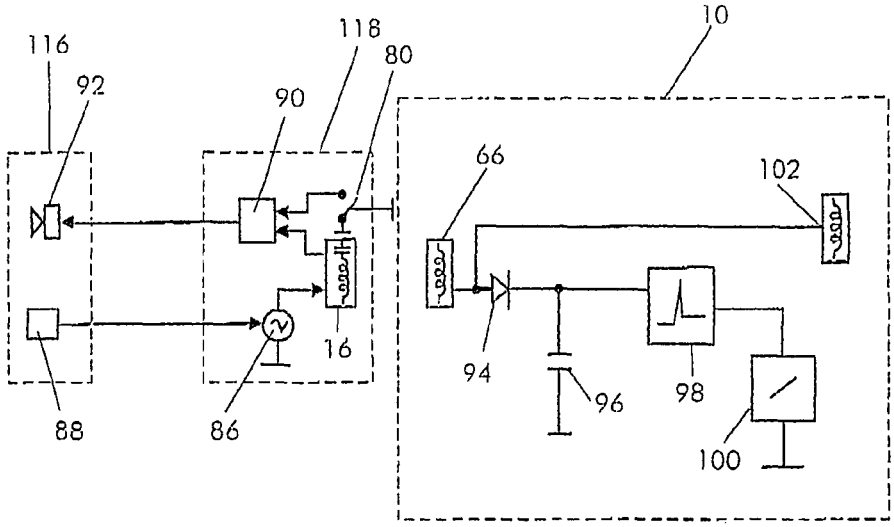
Figure 11:
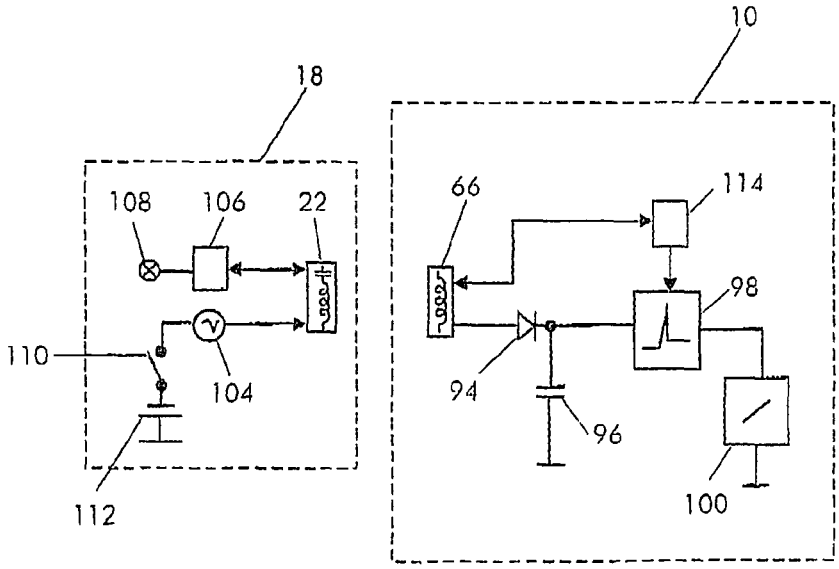

In the drawing:

FIG. 1 shows a schematic representation of a lock cylinder with actuation knob and energy feed from a protected region, FIG. 2 shows a schematic representation of a lock cylinder with key for energy feed and code transmission, FIG. 3 shows a view onto an actuation device and a lock bit of the lock cylinder in the unactuated state, FIG. 4 shows a view onto an actuation device and a lock bit of the lock cylinder in the unlocked and actuated state, FIG. 5 shows a view and a section through a lock cylinder in the unactuated state, FIG. 6 shows a view and a section through a lock cylinder in the locked and actuated state, FIG. 7 shows a view and a section through a lock cylinder in the unlocked and actuated state, FIG. 8 shows a door actuation handle with a lock cylinder according to the invention in the closed state, FIG. 9 shows a door actuation handle with a lock cylinder according to the invention in the opened state, FIG. 10 shows a simplified block diagram of an external controller with a station in the protected region and of a lock cylinder and FIG. 11 shows a simplified block diagram of a key and a lock cylinder.

FIG. 1 shows a schematic representation of a lock cylinder 10 with lock bit 12, actuation knob 14 of an actuation device and energy feed, via an induction loop as constituent of a resonant circuit 16, from a protected region. If the induction loop of the resonant circuit 16 is switched off, the actuation knob 14 can be pressed merely ineffectively, without moving the lock bit 12. When the induction loop of the resonant circuit 16 is switched on, the coupling of an internal unlocking device of the lock cylinder is coupled and the lock cylinder produces a positive or non-positive connection between the actuation device and the lock bit 12. When the actuation knob 14 is pressed, the lock bit 12 is also moved.

FIG. 2 shows a schematic representation of a lock cylinder 10 with lock bit 12 and a key 18 for energy feed and code transmission. When plugging the key 18 into a key accommodation 20 of the lock cylinder 10 using the key's compatible plug-in attachment 23, energy is transmitted to an internal induction loop of the lock cylinder 10 via an induction loop 22 of the key 18. A code is also transmitted at the same time and evaluated by an internal code evaluation circuit in the lock cylinder 10. In the case of a positive evaluation result, the coupling of an internal unlocking device of the lock cylinder is coupled. When the key 18 is rotated or pressed, the lock bit 13 can then also be moved.

FIG. 3 shows a view onto an actuation device 24 with an actuation knob 14 and a lock bit 12 of the lock cylinder 10 in the unactuated state. The lock bit 12 consists of two wings 30, 32 which can be pivoted about axes 26, 28 and are spread by a spring 34. The actuation device 24 is constructed as a bolt 38 which can be limited displaced relative to a stop bolt 36 and is pushed outwards by a spring 40 in the unactuated state.

A spring-loaded rocker arm 42 which is a constituent of a coupling of an unlocking device is connected to the bolt 38 in an articulated manner. The rocker arm 42 can assume two different rocker positions. In a decoupled position, it merely executes free travel with the bolt 38 when the latter is pushed in.

In a coupled position shown in FIG. 4, however, a front abutting surface 44 comes into engagement with actuation faces 46, 48 of the pivotable wings 30, 32 and pivots the latter inwards when the bolt 38 is pushed in and the rocker arm 42 is entrained. FIG. 4 accordingly shows a view onto the actuation device 24 in the unlocked and actuated state.

FIG. 5 shows a view and a section through a lock cylinder 10 in the unactuated state. The rocker arm 42 is mounted on the bolt 38 such that it can be rocked about an axis 50 and is pretensioned by a pressure spring 52 which aims to maintain an inclined orientation of the rocker arm 42. A support surface 54 of the rocker arm 42 is supported on a rocker 56, which is pretensioned by a spring 58 and aims to maintain a horizontal position of the rocker 56. An electromagnet 60 with a pivotable armature 62 is located below the rocker 56. The armature 62 is pretensioned by a spring 64 which aims to maintain a descended position of the armature 62. In the descended position of the armature 62, it fixes the rocker 56 in its horizontal position. A rectifier, an energy store and a control circuit for the electromagnet 60 are arranged on a printed circuit board 70.

The electromagnet 60 can be supplied with energy externally via an induction loop 66 and then attracts the armature. When the armature is descended, the rocker 56 remains fixed in its horizontal position. If the bolt 38 is then pushed in using the actuation knob 14, then the profiled support surface 54 of the entrained rocker arm slides over the fixed rocker 56 and orientates the rocker arm horizontally. In the horizontal position, the abutting surface 44 does not come into engagement with actuation faces 46 of the pivotable wings 30, but rather moves below the actuation faces 46. The rocker arm 42 executes free travel and the pivotable wings 30, remain in the spread position. This state is represented in FIG. 6, the locked and actuated state.

When supplying energy to the induction loop 66 externally, the electromagnet 60 is activated and attracts the armature. The rocker 56 initially remains still in its horizontal position as a result of the spring pretensioning, but it can now give way if it is acted upon by a force which overcomes the force of the spring 58. If this time, the bolt 38 is pressed in using the actuation knob 14, then the support surface 54 of the entrained rocker arm, which support surface is profiled and in parts configured as a slanting plane, likewise slides over the rocker 56. The force of the pressure spring 52 is however stronger than the force of the spring 58 and the profiled support surface 54 of the entrained rocker arm allows the rocker 56 to pivot downwards, while the rocker arm retains its inclined position. In this case, the abutting surface 44 comes into engagement with the actuation faces 46 of the pivotable wings 30 and pivots these inwards. This state is represented in FIG. 7, the unlocked and actuated state.

A design modification of the described coupling as a constituent of the internal unlocking device of the lock cylinder allows an actuation device constructed as a rotating cylinder to also be positively or non-positively connected to a rotatable lock bit. The rotating cylinder can be actuated with a rotary knob or a key. In the decoupled state it can be freely spun, in the coupled state it entrains the rotatable lock bit in order, e.g. to actuate a lock mechanism.

FIG. 8 shows a door actuation handle 72 with a lock cylinder 10 in a configuration according to the invention in the closed state and FIG. 9 shows it in the opened state.

A lock cylinder 10 with a press knob 14 is incorporated into a pivotable and rotatable door actuation handle 72. In the closed state, the door actuation handle 72 engages in a groove of a door mounting 76 fixed to a door 74 and is thus positively secured against rotation. On the reverse side of the door 74, the door mounting 76 is shaped to form a sleeve with grooves in the sleeve cover. The spread wings of the lock bit 12 engage in these grooves and fix the door actuation handle 72 in the groove of the sleeve by means of the lock cylinder 10. An external induction loop of a resonant circuit 16 for supplying energy to the lock cylinder 10 is arranged on a printed circuit board 78 in the protected region.

If the energy supply is switched off, then the press knob 14 can merely be pressed in ineffectively, without affecting the lock bit 12. If the energy supply is switched on, then the wings of the lock bit 12 are pivoted in when the push knob 14 is pressed and the door actuation handle 72 can be grasped with a finger by its lower nipple 82, which is formed by an undercut, and pivoted out. Then it can be rotated, in order, by means of its square bar 84, to pull back a door latch so that the door 74 can be opened. In the case of a subsequent closing of the door 74, the door actuation handle 72 is again rotated and pressed into being flush with the door mounting 76. The angled wings of the lock bit 14 initially retract independently during the insertion into the sleeve of the door mounting 76 and then spread under spring force into the grooves in the sleeve cover. It is possible to mechanically monitor whether the door actuation handle 72 is pressed on with the lock cylinder 10 and therefore whether the door 74 is locked or not by means of a switch 80 which is likewise arranged on the printed circuit board 78. The presence of the lock cylinder 10 can also be monitored electronically by detecting the damping of the induction loop of the resonant circuit 16.

FIG. 10 shows a simplified block diagram of an external controller 116 with a station 118 in the protected region and of a lock cylinder 10. The external controller 116 comprises a code evaluation circuit 88 and an alarm signalling device 92. The station 118 comprises an alternating-current source 86, which is controlled by the code evaluation circuit 88 via a control line, and an induction loop of a resonant circuit 16. Further, the station 118 comprises a lock-cylinder presence sensor, of which a constituent can be the same induction loop of the resonant circuit 16 in connection with a recognition circuit 90 or a mechanical switch 80. The recognition circuit 90 is connected to the alarm signalling device 92 via a signal line.

The lock cylinder 10 comprises an internal induction loop 66, downstream of which a rectifier 94, an energy store 96 and a control circuit 98 are connected. An actuator 100 is connected to the control circuit 98. The control circuit 98 has a control characteristic, in accordance with which, a charging procedure of the energy store 96 is initially awaited, after that the actuator 100 is acted on with an increased switch-on current applied by the energy store 96 in the switch-on phase and finally the actuator is acted on with a lower holding current applied by the induction loop 66 in the holding phase. An additional internal induction loop 102, which is connected to the rectifier 94 and is adjacent to the unprotected region, enables an energy supply to the emergency opening.

FIG. 11 shows a simplified block diagram of a key 18 and a lock cylinder 10. The key 18 comprises an alternating current source 104, a combined encoder and code evaluation circuit 106, a signalling device 108, a button 110, a battery 112 and an induction loop 22.

The lock cylinder 10 comprises a combined code evaluation and feedback circuit 114 in addition to the components described for FIG. 10. In the event of a positive evaluation result, the control circuit 98 is activated with the code evaluation circuit 114.

When pressing the button 110 in the key 18, the lock cylinder 10 is provided with energy and a code is transmitted from the encoder circuit 106 in the key 18 to the code evaluation circuit 114 in the lock cylinder 10. In the event of a positive evaluation, the control circuit 98 is activated for actuating the actuator 100 and feedback is transmitted to the key 18 and signalled via the signalling device 108.

The invention claimed is:

1. Lock cylinder arrangement consisting of a housing with a lock bit, an unlocking device and an actuation device, wherein the unlocking device comprises a coupling arranged between the actuation device and the lock bit, which coupling is decoupled in the locked state and coupled in the unlocked state, wherein the coupling can be actuated, via an electromagnetic actuator, with a control circuit which is externally fed with energy contactlessly, and wherein an induction loop which is fed with energy by means of an external induction loop and energy source and is arranged in the lock cylinder is connected upstream of the control circuit.

2. Lock cylinder arrangement according to claim 1, wherein the external induction loop and energy source is arranged in a protected region.

3. Lock cylinder arrangement according to claim 1, wherein the external induction loop and energy source is arranged in a key or operating device which is entrained by a user.

4. Lock cylinder arrangement according to claim 1, wherein the control circuit comprises an electrical energy store which can be charged by means of the induction loop and the actuator is acted on, by means of the control circuit, with an increased switch-on current applied by the energy store in the switch-on phase and is acted on with a lower holding current applied by the induction loop in the holding phase.

5. Lock cylinder arrangement according to claim 1, wherein the unlocking device comprises an electrical emergency opening device which is connected upstream of the control circuit and consists of an additional induction loop facing the unprotected region.

6. Lock cylinder arrangement according to claim 1, wherein the unlocking device comprises a mechanical emergency opening device which consists of a predefined break opening in the lock cylinder.

7. Lock cylinder arrangement according to claim 1, wherein the actuation device is a fixedly incorporated spring-loaded push, rotary or pull knob.

8. Lock cylinder arrangement according to claim 1, wherein the actuation device is a key accommodation with a key that is inserted from the outside.

9. Lock cylinder arrangement according to claim 1, wherein the control circuit is controlled by a code evaluation circuit which is external or is internal and arranged in the lock cylinder.

10. Lock cylinder arrangement according to claim 9, wherein the energy supply of the external induction loop in the protected region can be switched on and off via a control line by means of a central external code evaluation circuit.

11. Lock cylinder arrangement according to claim 1, wherein the external induction loop is a constituent of a lock-cylinder presence sensor, by means of which the coupling to the induction loop arranged in the lock cylinder can be monitored via an evaluation circuit.

12. Lock cylinder arrangement according to claim 9, wherein the control circuit can be activated directly by means of an internal code evaluation circuit in the lock cylinder in the event of code match via a control output of the code evaluation circuit.

13. Lock cylinder arrangement according to claim 12, wherein the induction loop arranged in the lock cylinder is constructed as a combined energy and code receiver, which receives energy and code from a key inserted into the key accommodation.

14. Lock cylinder arrangement according to claim 1, wherein the coupling of the unlocking device comprises a spring-loaded rocker arm which is coupled with the actuation device and can be pivoted between a position of engagement and a position of non-engagement with the lock bit, wherein a support surface of the rocker arm is supported on a spring-loaded rocker which can be pivoted between a coupled position and a decoupled position of the rocker arm and wherein the rocker is fixed in the relaxed position by an actuator in the an active state of the actuator and can be pivoted by force action of the rocker arm in a passive state of the actuator.

* * * * *